US005169253A

United States Patent [19]

Tsao

[11] Patent Number: 5,169,253

[45] Date of Patent: Dec. 8, 1992

[54] WRITING INSTRUMENT WITH A PROJECTOR MECHANISM

[76] Inventor: Yung-Chi Tsao, 2F, No. 27, Lane 419, Chung Mei Street, Taichung, Taiwan

[21] Appl. No.: 762,495

[22] Filed: Sep. 19, 1991

[51] Int. Cl.[5] ..... B43K 29/00; F41B 11/00; A63H 33/40

[52] U.S. Cl. ..... 401/195; 401/131; 446/180; 124/67

[58] Field of Search ..... 124/66, 67; 401/195, 401/52, 131, 109; 446/180, 71

[56] References Cited

U.S. PATENT DOCUMENTS

| | | | |
|---|---|---|---|
| 178,509 | 6/1876 | Carey | 124/67 |
| 1,150,248 | 8/1915 | Burrows | 124/67 |
| 2,725,038 | 1/1955 | Morris | 401/195 |
| 4,291,809 | 9/1981 | Lyon | 124/31 |

FOREIGN PATENT DOCUMENTS

| | | | |
|---|---|---|---|
| 416591 | 7/1925 | Fed. Rep. of Germany | 124/67 |
| 118548 | 5/1977 | France | 124/67 |

*Primary Examiner*—Danton D. DeMille
*Attorney, Agent, or Firm*—Wenderoth, Lind & Ponack

[57] ABSTRACT

A writing instrument with a projector mechanism includes a pen holder with an upper section for holding either a pen fixing blocking with a refill for writing purposes or a toy missile or other article for fun. The pen holder also includes a lower section for installation of a projector mechanism composed of a plunger, a push rod, a compression spring, a rtainer ring and a puller. By pulling the puller outwardly the plunger and the push rod are displaced, and the compression spring is compressed. Then release of the puller can result in a thrust force in the pen holder to project the toy missile or other article in the upper section of the pen holder for fun. Alternatively placing the pen fixing block with a refill in the upper section of the pen holder, the writing instrument can be used for writing.

8 Claims, 3 Drawing Sheets

WRITING INSTRUMENT WITH A PROJECTOR MECHANISM

BACKGROUND OF THE INVENTION (a) Field of the Invention

The present invention relates to a writing instrument with a projector mechanism, particular a writing instrument with a projector mechanism composed of a plunger, a push rod, a compression spring, a retainer ring and a puller placed in the lower section of its pen holder for fun while it can be used as a writing instrument as well.

(b) Description of the Prior Art

Conventional writing instruments have been well developed in appearance, but such appearance does not fully satisfy needs of children. Therefore, recent developments in writing instruments have stressed the attraction to children by improving the basic structure of the writing instruments in order to satisfy the curiosity of children.

SUMMARY OF THE INVENTION

The main object of the present invention is to provide a writing instrument with a projector mechanism so that it can serve as a writing instrument and a toy as well by using interior space in a pen holder for installation of a projector mechanism to launch missiles for fun.

Another object of the present invention is to provide a writing instrument with a projector mechanism to attract children so that they are willing to use it for writing and to satisfy them with its function as a toy.

DETAILED DESCRIPTION OF THE PREFERRED EMBODIMENT

Figure 1:
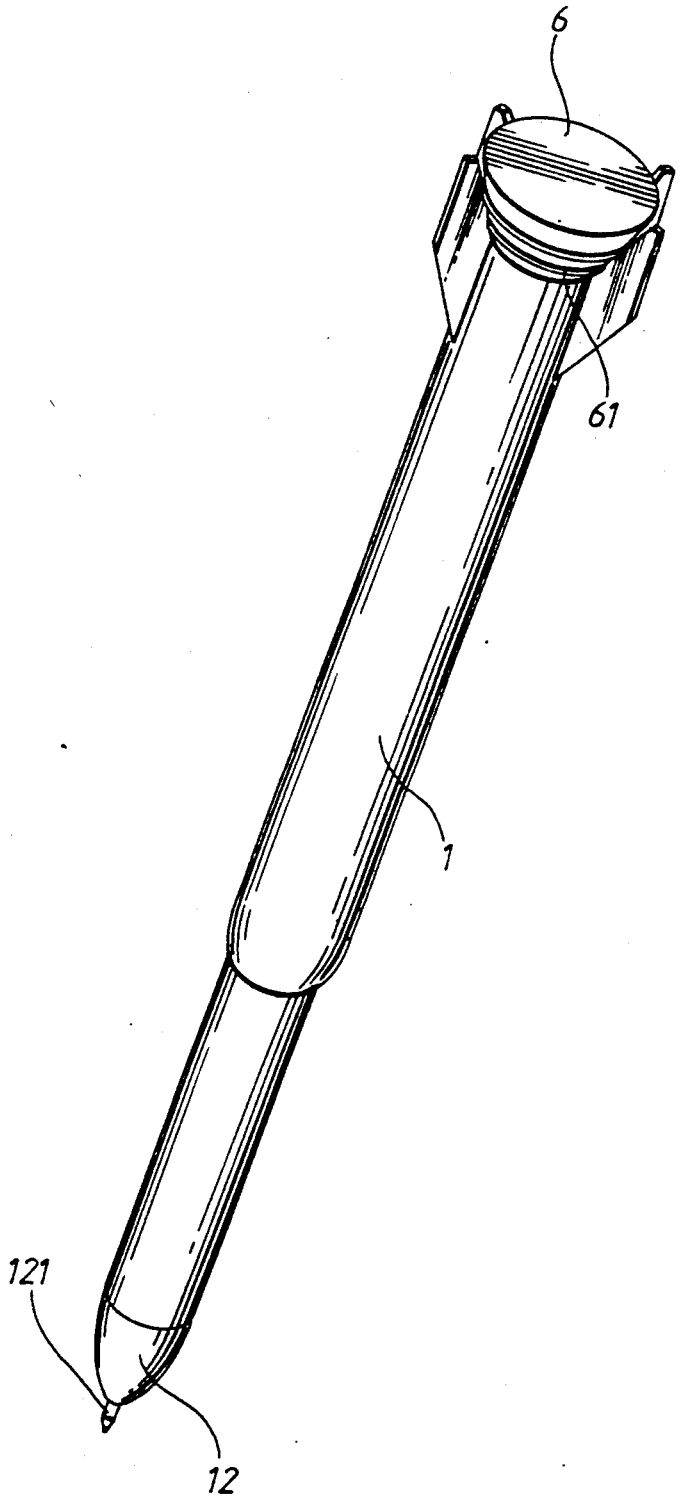
FIG. 1 is a perspective view of an embodiment of a writing instrument with a projector mechanism according to the present invention.
Figure 2:
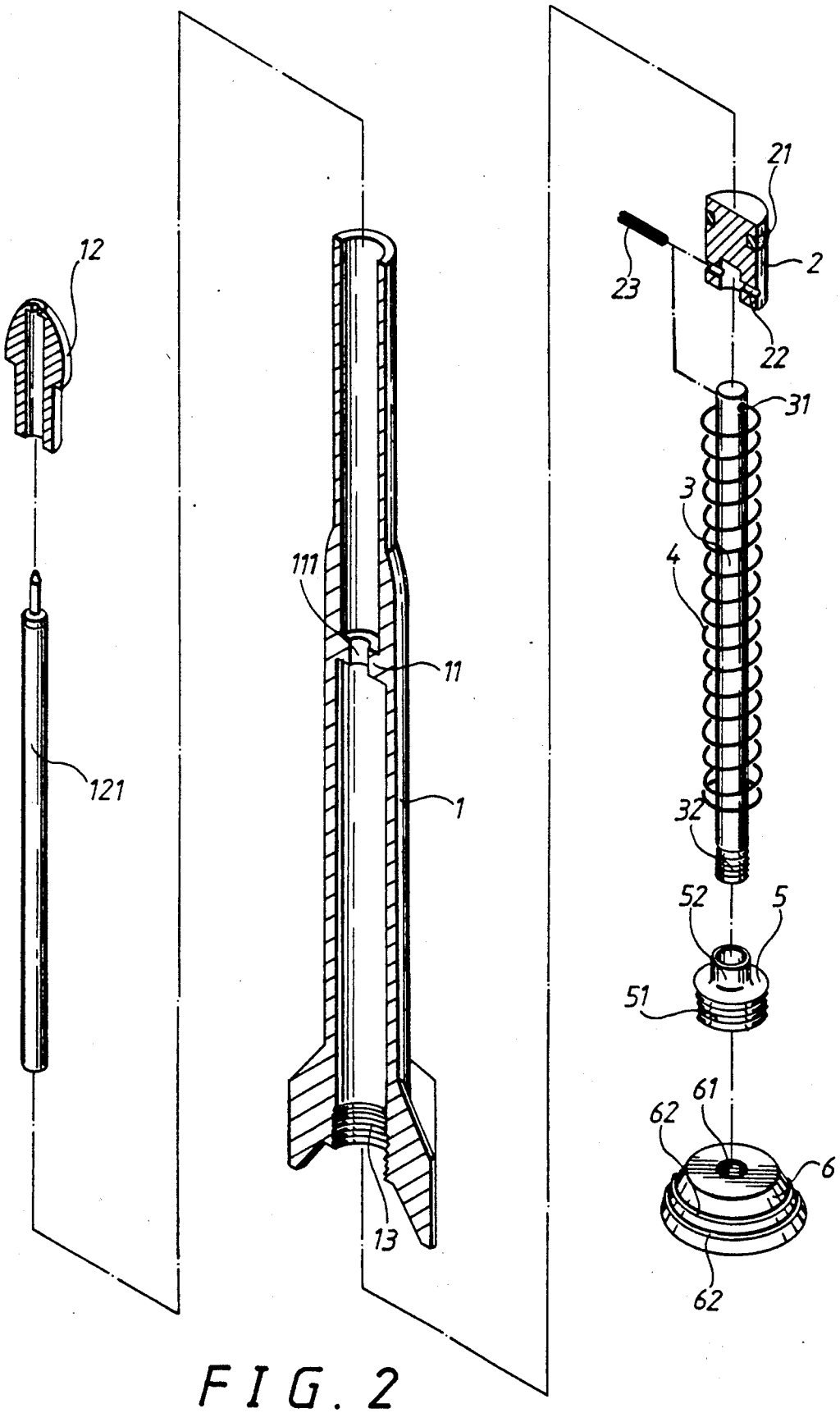
FIG. 2 is an exploded perspective view of the writing instrument with a projector mechanism according to the present invention.

As shown in FIGS. 1 and 2, a writing instrument according to the present invention is composed of a pen holder (1), a plunger (2), a push rod (3), a compression spring (4), a retainer ring (5) and a puller (6).

The pen holder (1) is in the form of a hollow tubular structure having a partition portion (11) in the middle section. The partition portion (11) has a hole (111) at the center. The upper section of the pen holder (1) is for holding of a toy missile (7), or a pen fixing block (12) for fixing of an appropriate refill (121) for writing purposes. The lower section of the pen holder is designed with an inner thread (13) on the inner wall of its opening.

The plunger (2) is surrounded by an airtight ring (21), and has a transverse pin hole extending through its center line for insertion of a fixing pin (23) for connecting to the push rod (3) beneath it.

The push rod (3) is in the form of a rod having a transverse hole (31) at the upper end and an appropriate outer thread (32) at the lower end, and it is for placing and positioning of the compression spring (4).

Figure 3:
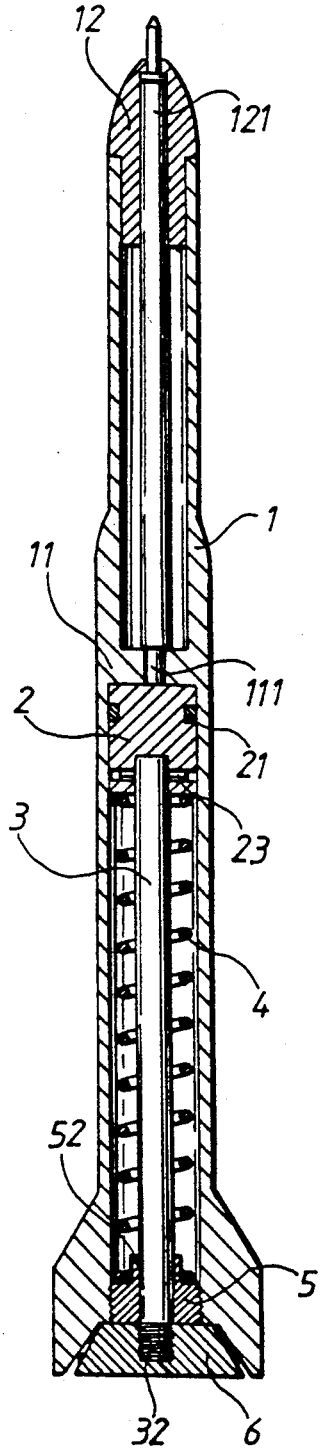
FIG. 3 is a sectional view of the writing instrument with a projector mechanism according to the present invention.

The retainer ring (5) has an outer thread on its circumference, and a small stepped annular portion (52) extending from its center for placing and positioning of the said compression spring (4), as shown in FIG. 3.

The puller (6) is designed in the form of an appropriate annular structure having a screw hole (61) in the center. The puller can be a tapered structure to facilitate pulling, and has one or more annular ribs (62) to help in gripping it.

Figure 4:
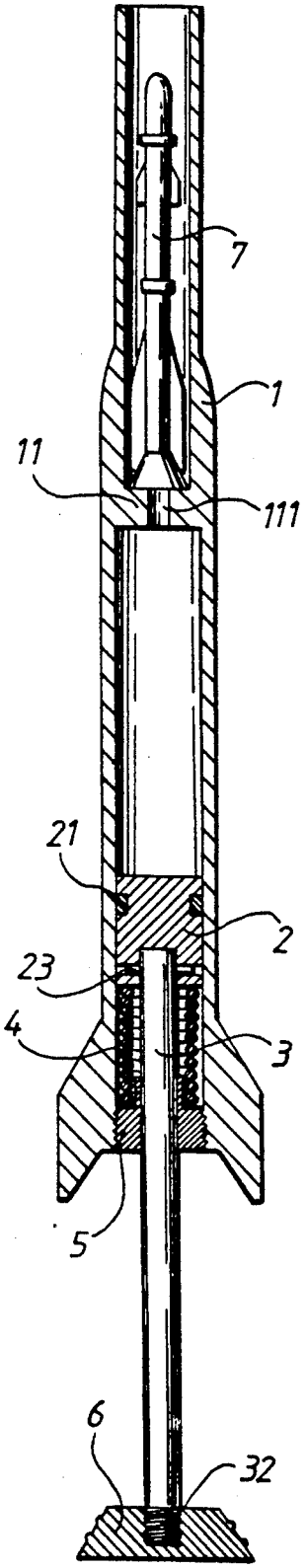
FIG. 4 illustrates a launching action of the projector mechanism according to the present invention.

With the above components, the push rod (3) is first connected to the plunger (2), the compression spring (4) is placed to surround them before they are placed into the lower section of the pen holder (1). The retainer ring (5) is placed into the opening of the lower end of the pen holder (1) so as to cause the push rod to penetrate the retainer ring (5) and be fixed to the puller (6) to thus construct a writing instrument with a projector mechanism as shown in FIG. 3. With such an assembly, when the puller (6) is pulled outward for a certain distance, the plunger (2) and the push rod (3) are displaced so that the compression spring (4) is compressed as shown in FIG. 4, then release of the puller can result in a thrust force in the pen holder (1) to project the toy missile (7) or other article placed in the upper section of the pen holder (1) for fun.

The toy missile (7) or other article placed in the upper section of the pen holder (1) can be provided with a soft rubber head or other safety measure to assure safety, and such kind of missile or bullet is available in the market, and will not be described here.

I claim:

1. A writing instrument having a projector mechanism, comprising:

a hollow tubular pen holder having an upper end and a lower end;

a partition portion provided in said hollow tubular pen holder intermediate said upper and lower ends thereof in order to define an upper hollow tubular section for receiving a toy to be projected or a pen refill, and a lower hollow tubular section;

a plunger longitudinally slidably mounted in said lower hollow tubular section of said hollow tubular pen holder;

a retainer ring mounted in said lower hollow tubular section at said lower end of said pen holder;

a push rod having a top end and a bottom end, being slidably mounted through said retainer ring, and having said top end fixed to said plunger, such that said push rod is slidable together with said plunger between a retracted position in which said plunger is positioned adjacent said partition portion and said push rod is housed substantially within said lower hollow tubular section, and an extended position in which said push rod extends below said lower end of said pen holder;

a compression spring mounted about said push rod and interposed between said plunger and said retainer ring;

a puller member fixed to aid bottom end of said push rod; and a pen fixing block removably mounted in said upper end of said pen holder and including a means for securing a pen refill in said fixing block, such that, when said fixing block is mounted in said pen holder, a pen refill can be mounted in said upper hollow tubular section of said pen holder for writing purposes and, when said fixing block is removed from said pen holder, a toy to be projected can be inserted in said upper hollow tubular section of said pen holder.

2. A writing instrument as recited in claim 1, wherein said retainer ring is formed with external threads which are mated with internal threads formed in said lower hollow tubular section at said lower end of said pen holder;

said retainer ring includes an upwardly projecting annular stepped portion, said compression spring being mounted about said stepped portion for positioning said compression spring;

said plunger includes a longitudinally extending central recess which opens downwardly and a transverse pin hole traversing said central recess, said push rod has a transverse pin hole formed adjacent said top end thereof and which registers with said pin hole of said plunger, and a pin is inserted through said pin holes of said push rod and said plunger for fixing said plunger to said push rod;

an airtight ring is mounted about said plunger; and said puller member has an internally threaded upwardly opening central recess formed therein, and said push rod is provided at its bottom end with external threads mated with said internal threads of said puller member.

3. A writing instrument as recited in claim 1, wherein said retainer ring is formed with external threads which are mated with internal threads formed in said lower hollow tubular section at said lower end of said pen holder.

4. A writing instrument as recited in claim 1, wherein said retainer ring includes an upwardly projecting annular stepped portion, said compression spring being mounted about said stepped portion for positioning said compression spring.

5. A writing instrument as recited in claim 1, wherein said plunger includes a longitudinally extending central recess which opens downwardly and a transverse pin hole traversing said central recess, said push rod has a transverse pin hole formed adjacent said top end thereof and which registers with said pin hole of said plunger, and a pin is inserted through said pin holes of said push rod and said plunger for fixing said plunger to said push rod.

6. A writing instrument as recited in claim 1, wherein an airtight ring is mounted about said plunger.

7. A writing instrument as recited in claim 1, wherein said puller member has an internally threaded upwardly opening central recess formed therein, and said push rod is provided at its bottom end with external threads mated with said internal threads of said puller member.

8. A writing instrument as recited in claim 1, further comprising a pen refill removably secured in said pen fixing block.

* * * * *